United States Patent [19]

Watanabe

[11] Patent Number: 5,013,267

[45] Date of Patent: May 7, 1991

[54] ELECTRIC CONNECTOR

[75] Inventor: Mistutoshi Watanabe, Kawasaki, Japan

[73] Assignee: Kabushiki Kaisha Shinko, Tokyo, Japan

[21] Appl. No.: 476,729

[22] Filed: Feb. 8, 1990

[51] Int. Cl.[5] ..... H01R 4/48

[52] U.S. Cl. ..... 439/821; 439/819

[58] Field of Search ..... 439/819, 820, 821, 833, 439/839, 840, 841, 851, 856

[56] References Cited

U.S. PATENT DOCUMENTS 3,127,492 3/1964 Date ..... 439/821
3,982,806 9/1976 Wilson et al. ..... 439/820

FOREIGN PATENT DOCUMENTS 0322642 7/1989 European Pat. Off. ..... 439/839
1071799 12/1959 Fed. Rep. of Germany ..... 439/839
59-27048 7/1984 Japan .

*Primary Examiner*—David L. Pirlot
*Attorney, Agent, or Firm*—Wenderoth, Lind & Ponack

[57] ABSTRACT

A connector is made from a circular cylindrical body split into a plurality of unit arcuate conductive strip materials in the axial direction. A desired number of the arcuate conductive strip materials are arranged in an annular shape to form a cylindrical socket body defining a plug inserting hole. A plurality of annular grooves are formed along the outer peripheral surface of the cylindrical socket body, and a spring band is wound on each of the annular grooves so that a group of the conductive strip materials of the cylindrical socket body are bundled in such a manner as to be able to expand and contract.

3 Claims, 2 Drawing Sheets

ELECTRIC CONNECTOR

BACKGROUND OF THE INVENTION

1. Field of the Invention

This invention relates to a connector for interconnecting, for example, an electric power source and a piece of equipment, and which is particularly suitable for feeding a large amount of electric power to the equipment.

2. Brief Description of the Prior Art

As related prior art, there can be listed Japanese Patent Publication No. Sho 59-27048. The invention disclosed in this Publication has the following construction. Six conductive strip materials having an equilateral hexagonal configuration in section are bundled together, by a spring band, in such a manner as to form a hollow member so as to form a socket. The arrangement is such than when a plug for a power source and a plug for a piece of equipment are inserted into the plug inserting hole defined by the hexagonal conductive strip materials under pressure from each side, the conductive strip material group is increased in diameter against a binding force of the spring band so as to permit the plugs to be inserted into the plug inserting hole under pressure from each side. At the same time, the respective conductive strip materials are contacted, under pressure, with the plugs by means of the binding force of the band, and when the plugs are withdrawn from each side of the plug inserting hole, the respective conductive strip materials are reduced in diameter by the binding force of the spring band.

The socket is comprised of a plurality of equilateral hexagonal conductive strip material units bundled into a hollow member, and the socket is limited to a six-split structure. In other words, the socket is designed such that it is difficult to increase the contact spots with the plugs by increasing the number of split portions (strips).

For the same reason, the external configuration of each socket is necessarily formed such that humps and valleys are arranged in turn. There is a fear that the conductive strip material group is one sided owing to the provision of the deep valleys, and is not properly increased or decreased in diameter. In addition, because of the structure having humps and valleys arranged in turn, the spring band is wound on the intermittently formed grooves. Accordingly, it becomes an unstable structure in which the binding force is intermittently exerted to the respective conductive strip materials. As a consequence, the valleys act as escape grooves for the conductive strip materials, and the conductive strip materials are easily one sided.

Furthermore, the above-mentioned conductive strip materials are formed by cutting a hexagonal deformed bar material into a predetermined size. The deformed bar material is very expensive. In addition, it is required to obtain a specially deformed bar material having an octagonal shape, or more sides in order to increase the number of splits of the socket. Therefore, it is not commercially practicable. As a result, the above-mentioned conventional product can not expect an increased split number.

SUMMARY OF THE INVENTION

It is therefore a general object of the present invention to provide a connector which is capable of effectively solving the the above-mentioned problems.

In order to solve the above-mentioned problems, there is essentially provided a connector characterized in that a correct circular cylindrical body is split into a plurality of unit arcuate conductive strip materials in the axial direction, a desired number of the arcuate conductive strip materials are arranged in an annular shape to form a cylindrical socket body defining a plug inserting hole, a plurality of annular grooves are formed along the outer peripheral surface of the cylindrical socket body, and a spring band is wound on each of the annular grooves so that a group of the conductive strip materials of the cylindrical socket body are bundled in such a manner as to be able to expand and contract.

From another aspect of the invention there is provided a connector, wherein the cylindrical socket body comprises a larger number of unit arcuate conductive strip materials than the split number of the correct circular cylindrical body arranged in an annular shape.

From a further aspect of the invention, there is provided a connector wherein an annular groove is formed in an internal peripheral surface of the cylindrical socket body, an internal surface regulating disk is fitted into the annular groove, and the internal peripheral surface of the group of arcuate conductive strip materials is restricted by the internal surface restricting disk.

From a still further aspect of the invention, there is provided a connector wherein the cylindrical socket body has an annular groove formed in an internal peripheral surface thereof, an internal surface regulating disk is fitted in the annular groove so that an internal peripheral surface of the arcuate conductive strip material group is regulated by the internal surface regulating disk, and one end of a fixed plug, which is inserted into a plug inserting hole from one end thereof under pressure, is threadedly secured to the internal surface regulating disk.

According to the present invention, unit arcuate conductive strip materials are prepared by splitting a cylindrical body into a plurality of strips of a desired number, and such a plurality of unit arcuate conductive materials are arranged in an annular shape to thereby provide a split movable type cylindrical socket.

The number of the arcuate conductive strip materials can be increased as desired to thereby form a cylindrical socket in accordance with an amount of electric power to be fed.

Furthermore, the arcuate conductive strip materials are arranged in an annular shape and provided with an annular groove formed in the peripheral surface thereof. Then, a spring band is wound on the annular groove to render an equal binding force to the arcuate conductive strip material group. Accordingly, the arcuate conductive strip materials can be stably increased or decreased in diameter.

Moreover, as the circular cylindrical member can be split into equal parts as a raw material, there can be realized a great cost reduction.

The above and other objects and attendant advantages of the present invention will be readily apparent to those skilled in the art from a reading of the following detailed description in conjunction with the accompanying drawings which show one preferred embodiment of the present invention for illustration purposes only, but do not limit the scope of the same in any way.

DETAILED DESCRIPTION OF THE EMBODIMENT

One preferred embodiment of the present invention will now be described with reference to the accompanying drawings.

Figure 7:
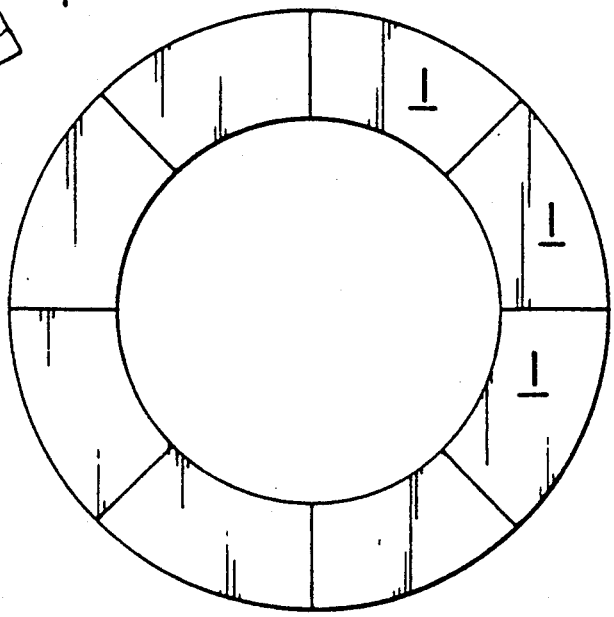
FIG. 7 shows a circular cylindrical member as raw material of the arcuate conductive strip material and is an end face view for explaining one example in which the circular cylindrical member is split into equal portions in order to form the arcuate conductive strip materials.

As is shown in FIG. 7, a long pipe is cut into a predetermined length, and such obtained circular cylindrical material is used as raw material. The circular cylindrical material is split into a plurality of equal portions in the axial direction on its diameter line at an equal split angle to prepare unit arcuate conductive strip materials 1.

Figure 1:
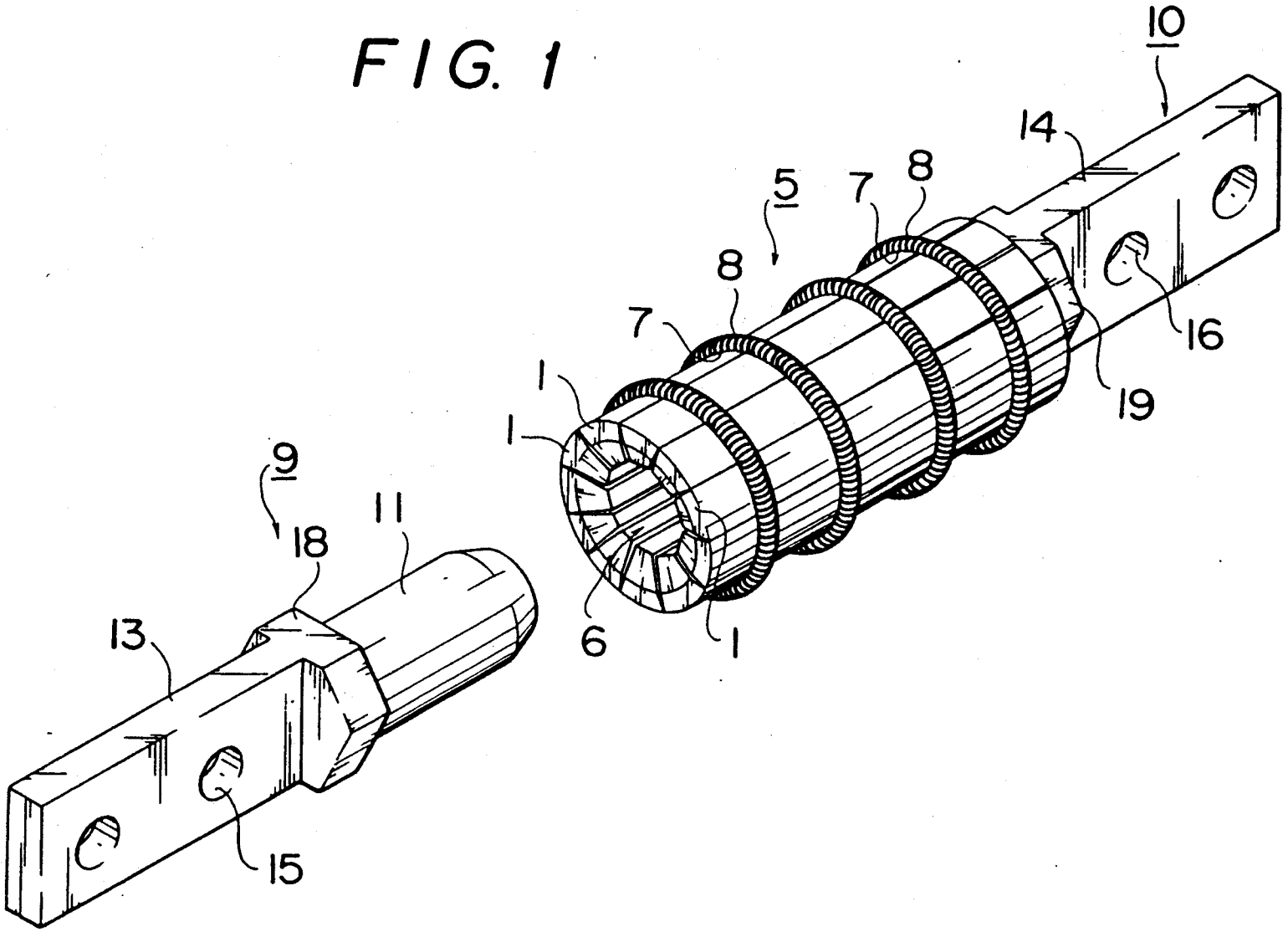
FIG. 1 is a perspective view of a connector showing the embodiment of the present invention.
Figure 2:
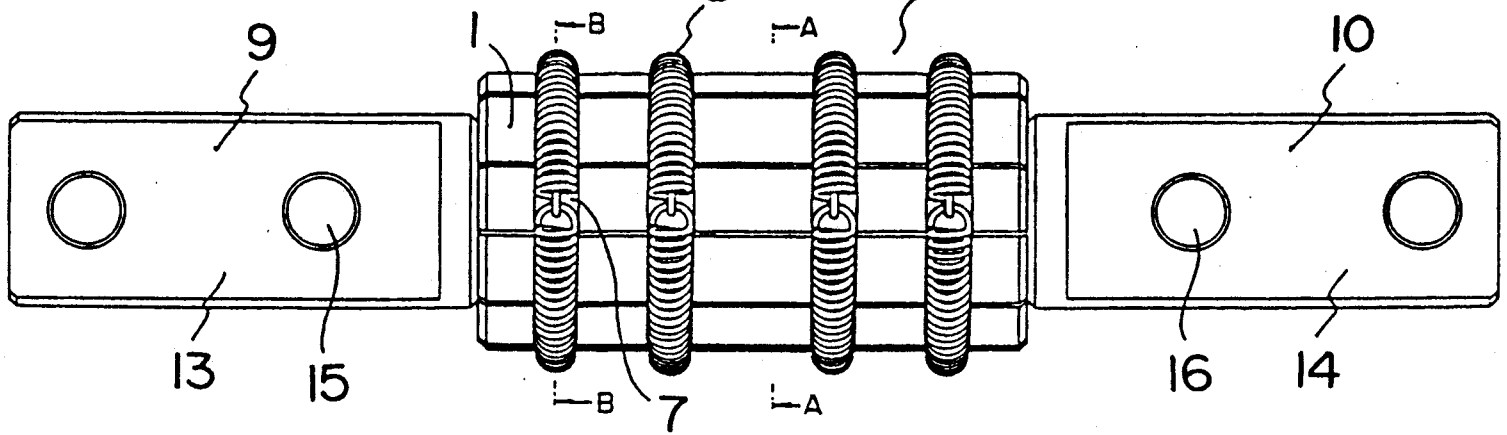
FIG. 2 is a side view thereof.
Figure 3:
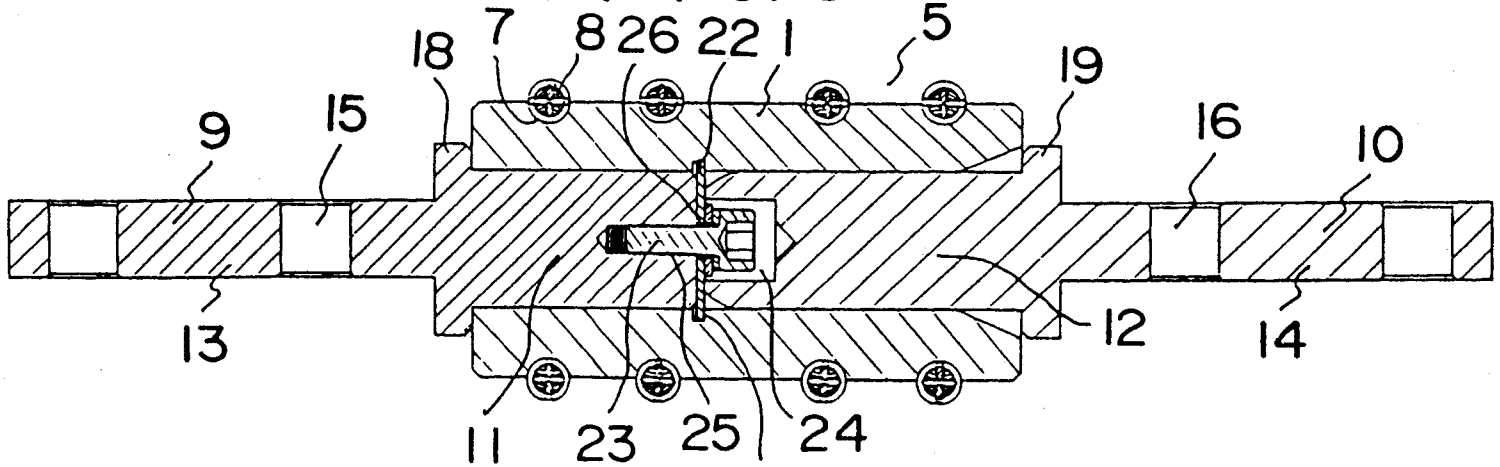
FIG. 3 is a vertical sectional view thereof.
Figure 4:
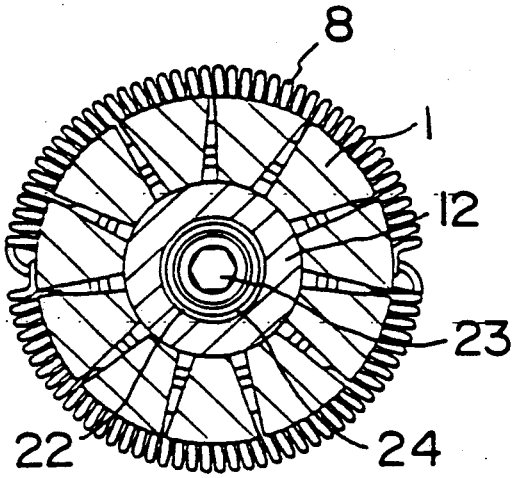
FIG. 4 is a sectional view taken on line A—A of FIG. 2.
Figure 5:
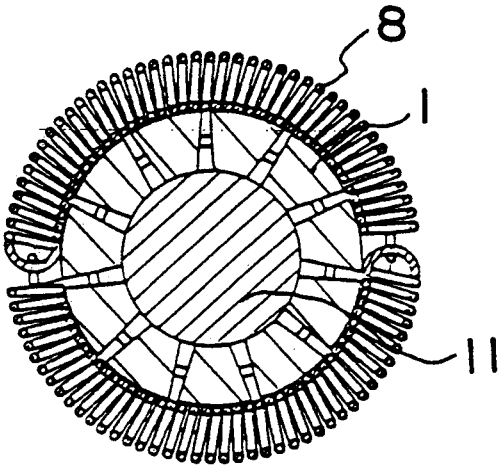
FIG. 5 is a sectional view taken on line B—B of FIG. 2.
Figure 6:
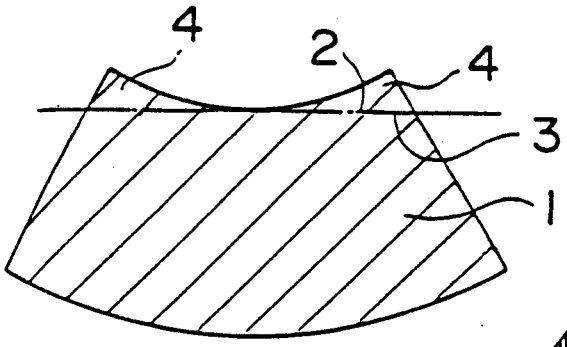
FIG. 6 is a sectional view of an arcuate conductive strip material.

A marginal portion of an internal arcuate surface of each of the arcuate conductive strip materials 1 is removed as shown by the borken line 3 of FIG. 6 to form a plane surface 2. And an end face of the strip material is formed into a dish shape. The resulting pluarlity of arcuate conductive strip materials are arranged in an annular shape to form a cylindrical socket body 5. The cylindrical socket body has a plug inserting hole opened up at both ends thereof and defined by the group of arcuate conductive strip materials 1.

The cylindrical socket body 5 is formed of a larger number of unit arcuate conductive strip materials 1 than the split number. In other words, since each of the arcuate conductive strips is formed from a cylinder, they will have an outside periphery with a circular arc shape, and have an arc angle which is the same as the remaining arcuate conductive strips. Note for example FIG. 7. The arcuate conductive strips then together total, in terms of arc ange, at least 360° plus the arc angle of one of the arcuate conductive strips, since there is at least one more arcuate conductive strip than is found in the cylinder as seen in FIG. 7.

For example, as is shown in FIG. 7, the circular cylindrical material as a raw material is split into eight equal parts to prepare the unit arcuate conductive strip materials 1. Nine or more, for example, eleven, of such obtained unit arcuate conductive strip materials 1, illustrated, are formed into the socket body 5.

The outer peripheral surface of the cylindrical socket body 5 becomes an annular peripheral surface. The internal peripheral surface of the cylindrical socket body 5 of the plug inserting hole 6 is formed into a peripheral surface formed of a plurality of arcuate surfaces or into a polyhedron having the above-mentioned plane surfaces.

The socket body 5 has a plurality of annular grooves 7 spacedly arranged on the outer peripheral surface thereof in the axial direction. A spring band 8 formed of a coil spring is wound on each of the annular grooves 7 in order to bind the cylindrical socket body 5 to keep its shape.

The spring bands 8 render an equal binding force to each and every arcuate conductive strip material 1. Each of the arcuate conductive strip materials 1 is increased in diameter against the binding force of the spring bands 8 and reduced in diameter in accordance with the binding force.

The reference numeral 9 denotes a fixed plug which is inserted into one end of the plug inserting hole 6 extending throughout the socket body 5 under pressure against the force of the spring band 8. The reference numeral 10 denotes a withdrawable plug which is inserted into the other end of the plug inserting hole 6 under pressure. The arrangement is such that when the plug 10 is inserted under pressure, the respective conductive strip materials 1 are increased in diameter and at the same time maintain contact by the binding force of the spring bands 8.

Inserting portions 11 and 12 of the plugs 9 and 10 have a cylindrical column shape. In case the internal surface of the conductive strip materials 1 group is formed in plane surface, a plug bus bar is brought into contact with the internal plane surface 2 of each of the arcuate conductive strip materials 1 on the axial line under pressure. One of the plugs 9 and 10 is connected to, for example, the power side, while the other is connected to the equipment side. Flat plate type couplers 13 and 14, as connecting means, are attached to projecting ends of the plugs 9 and 10. The couplers 13 and 14 have mounting holes 15 and 16 formed in side surfaces thereof. An instrument side or power side coupler is intimately attached to both sides of the couplers 13 and 14 and tightened by bolts through the mounting holes 15 and 16. A connecting portion between the couplers 13 and 14 and the respective inserting portions 11 and 12 is provided with a respective flange 18 and 19, and the inserting depth of the plugs 9 and 10 is set.

Furthermore, an annular groove 21 is formed in the peripheral direction crossing the internal peripheral surface of the cylindrical socket 5, i.e., the inner surface of each of the arcuate conductive strip materials 1. A circular internal surface regulating disk 22 is fitted into the annular groove 21 in order to regulate the internal peripheral surface of the arcuate conductive strip materials 1 by the peripheral surface of the internal surface regulating disk 22 to thereby arrange the respective strip materials 1 in a circular shape at the same time, the disk 22 maintains the circular shaped arrangement against the binding force of the spring bands 8.

Also, the inserting portion 11 of the fixed plug 9 is inserted from one end of the plug inserting hole 6 under pressure, its end face is abutted with the internal surface regulating disk 22 and tightened by screw means. That is, the end face of the inserting portion 11 is provided with a screw hole 25 into which a screw 23 is threadedly engaged. The screw 23 inserted into the mounting hole 26 of the internal surface regulating disk 22 is threadedly engaged with the screw hole 25 and the fixed plug 9 is secured to the socket body 5 through the internal surface regulating disk 22. As for the screw means, it may be designed such that a male screw is formed on the fixed plug 9 in such a manner as to project from an end face of the fixed plug 9, with the male screw inserted into the mounting hole 26 of the internal surface regulating disk 22 so as to be tightened by a nut.

The fixed plug 9 can be withdrawn from the plug inserting hole 6 by releasing the screw 23 by means of a tool inserted from the other opening portion of the plug inserting hole 6.

The withdrawable plug 10 is provided with a hole 24 having a bottom formed in the end face thereof so that a head portion of the screw 23 rests in the hole 24. By virtue of the foregoing arrangement, the dead space in the socket is eliminated and a contact length of the plug is obtained.

As described in the foregoing, according to the present invention, a circular cylindrical member is split into a desired number of unit arcuate conductive strip materials, and a desired number of such obtained unit arcuate conductive strip materials are bundled together. In this way, an intended cylindrical socket, which can be increased and decreased in diameter, can be formed with ease.

By increasing the number of the arcuate conductive strip materials as desired, there can be obtained a socket body having a necessary number of split portions according to use conditions.

The arcuate conductive strip materials forming the socket body are bundled into an annular shape, and a band is wound on each annular groove formed in the outer peripheral surface thereof. In this way, an equal binding force can be rendered to the respective arcuate conductive strip materials and the respective arcuate conductive strip materials can be stably increased and decreased in diameter.

Furthermore, as a circular cylindrical member can be split as raw material, there can be attained a significant cost reduction.

Moreover, by regulating the arcuate conductive strip materials group with the internal surface regulating plate, the cylindrical arrangement of the respective strip materials can be properly maintained.

While one preferred embodiment of the invention has been shown and described in detail, it will be understood that the same is for illustration purpose only, but not to be taken as a definition thereof and reference should be given to the appended claims for that purpose.

What is claimed is:

1. A connector, comprising:

a plurality of arcuate conductive strips, said plurality of arcuate conductive strips being arranged in an annular shape forming a substantially cylindrical socket body having a plug inserting hole therethrough;

a plurality of annular grooves along the outer peripheral surface of said substantially cylindrical socket body;

a spring band in each of said annular grooves for holding said plurality of said arcuate conductive strips in said annular shape forming said substantially cylindrical socket body and allowing said arcuate conductive strips to expand and contract;

an internal annular groove on the internal peripheral surface of said substantially cylindrical socket body;

an internal surface regulating disk fitted in said annular groove for regulating the internal peripheral surface of said arcuate conductive strips; and a fixed plug inserted into said plug inserting hole threadedly secured to said internal surface regulating disk.

2. The connector as set forth in claim 1, wherein:

each of said arcuate conductive strips has an outside periphery with a circular arc shape and having an arc angle the same as the remaining said arcuate conductive strips; and said plurality of arcuate conductive strips together total, in terms of arc angle, at least 360° plus the arc angle of one said arcuate conductive strip.

3. A connector, comprising:

a plurality of arcuate conductive strips, said plurality of arcuate conductive strips being arranged in an annular shape forming a substantially cylindrical socket body having a plug inserting hole therethrough, wherein each of said arcuate conductive strips has an outside periphery with a circular arc shape and an arc angle the same as the remaining said arcuate conductive strips, and said plurality of arcuate conductive strips together total, in terms of arc angle, at least 360° plus the arc angle of one said arcuate conductive strip;

a plurality of annular grooves along the outer peripheral surface of said substantially cylindrical socket body; and a spring band in each of said annular grooves for holding said plurality of said arcuate conductive strips in said annular shape forming said substantially cylindrical socket body and allowing said arcuate conductive strips to expand and contract.

* * * * *